United States Patent [19]

Sharp

[11] Patent Number: 4,465,231

[45] Date of Patent: Aug. 14, 1984

[54] CONTROL DEVICE AND METHOD FOR ACTIVATING A FUEL INJECTOR NOZZLE

[75] Inventor: Richard F. Sharp, Perry, Okla.

[73] Assignee: Deere & Company, Moline, Ill.

[21] Appl. No.: 362,815

[22] Filed: Mar. 29, 1982

[51] Int. Cl.[3] ..... F02D 7/00

[52] U.S. Cl. ..... 239/5; 239/126; 239/533.5; 239/533.8

[58] Field of Search .... 239/5, 124, 126, 533.3–533.12, 239/584

[56] References Cited

U.S. PATENT DOCUMENTS

| | | | |
|---|---|---|---|
| 4,153,205 | 5/1979 | Parrish, Jr. | 239/533.9 |
| 4,215,821 | 8/1980 | Eblen | 239/533.4 |
| 4,269,360 | 5/1981 | Kopse | 239/533.8 |
| 4,284,049 | 8/1981 | Chmela | 239/533.9 |

FOREIGN PATENT DOCUMENTS

| | | | |
|---|---|---|---|
| 487403 | 10/1952 | Canada | 239/533.8 |
| 879936 | 4/1953 | Fed. Rep. of Germany | 239/533.8 |
| 958772 | 3/1950 | France | 239/533.8 |
| 28656 | 12/1932 | Netherlands | 239/533.9 |
| 163396 | 3/1958 | Sweden | 239/533.3 |
| 762684 | 12/1956 | United Kingdom | 239/533.3 |

*Primary Examiner*—Andres Kashnikow
*Assistant Examiner*—Michael J. Forman

[57] ABSTRACT

A control device and method for opening and closing the nozzle of a fuel injector. The control device includes first and second cavities which are formed in the body of the fuel injector, with the second cavity being located close to the nozzle. First and second variable pressure supply chambers are connected to the nozzle and to the two cavities by several fluid passages. A spool valve and a needle valve are positioned in the first and second cavities, respectively, with the spool valve abutting a stem which projects into and terminating in the second cavity. Also situated in the second cavity between the stem and the needle valve is a spring which forms a link therebetween. The spool valve is pressure-actuated by a difference of pressure in the first and second pressure chambers to move between an open and a closed position. In the open position, fluid flow from one of the pressure chambers is permitted through the spool valve and to the second cavity. As the fluid pressure in the second cavity increases to a value greater than the compressive force of the spring, the needle valve will open and allow fluid flow through the nozzle of the fuel injector. As the spool valve moves to its closed position, it compresses the spring further and then urges the needle valve to close. The needle valve closes prior to a drop in fluid pressure in the second cavity.

22 Claims, 4 Drawing Figures

CONTROL DEVICE AND METHOD FOR ACTIVATING A FUEL INJECTOR NOZZLE

FIELD OF THE INVENTION

This invention relates to a control device and a method for opening and closing the nozzle of a fuel injector.

BACKGROUND OF THE INVENTION

With the advancement in engine designs, there is a need to provide a control device for fuel injectors such that the nozzles can be opened and closed rapidly and precisely. It is known that a sharp cut off of fluid through the nozzle and into a combustion chamber of an engine will provide for better combustion, less smoke and lower emissions. In addition, a sharp cut off of fuel into the combustion chamber can eliminate secondary injections. Up until now, most manufacturers have tried to provide a sharp cut off of fuel through the nozzle by utilizing an differential area valve which was spring biased to a closed position and was opened in response to fluid pressure impinging on the exposed surface of the valve. Two such control valves are described in U.S. Pat. Nos. 4,153,205, issued to Parrish, Jr. in 1979 and 4,269,360, issued to Hopse in 1981. Although such control valves are effective in preventing secondary injection of fuel into the combustion chamber after the valve closes, they do require an equal or a higher pressure to open than to close and this compromises the sharp cut off of fuel through the nozzle.

Now a control device and a method for operating the control device have been invented which provides for a sharp cut off of fuel through the nozzle of a fuel injector and which employs a higher pressure to close than to open.

SUMMARY OF THE INVENTION

Briefly, this invention relates to a control device and a method for opening and closing the nozzle of a fuel injector. The control device includes first and second cylindrical cavities formed in the fuel injector such that the second cylindrical cavity is located adjacent to the nozzle through which fuel is injected into the combustion chamber of an engine. The cylindrical cavities are fluidly connected to first and second variable pressure fluid supply chambers formed in the injector body and to each other by passages which are so arranged as to permit movement of a spool valve and a differential area needle valve in the first and second cavities, respectively. The spool valve abuts a stem that extends into the second cylindrical cavity and terminates at a cross-member. The cross-member, in turn, is biased by a compression spring away from the upper surface of the needle valve such that upward movement of the needle valve, away from its seat, is accomplished against the compression force of the spring. The force needed to compress the spring is thereby transmitted through the cross-member and stem to the spool valve and acts to urge the spool member upward or to an open position. With the needle valve closed and the spool valve in an open position, fluid is permitted to flow from the second variable pressure chamber through the second cylindrical cavity and to a chamber under the needle valve. As the pressure under the needle valve increases beyond a predetermined value, the needle valve will lift from its seat and allow fluid to pass through the nozzle. As the pressure of the incoming fluid decreases, a differential pressure is created between the first and second pressure chambers and the spool valve is urged downward thereby blocking off or restricting fluid flow to the underside of the needle valve. However, before the needle valve senses this pressure drop on its lower surface, it has already started to move downward and shut off fluid flow through the nozzle in reaction to the downward movement of the spool valve. Such a control device provides for a sharper cut off of fuel into the combustion chamber of an engine and thereby provide for better combustion.

The general object of this invention is to provide a control device for opening and closing the nozzle of a fuel injector and a method for using such a device. A more specific object of this invention is to provide a control device for the nozzle of a fuel injector which will open and close the nozzle very rapidly and precisely.

Another object of this invention is to provide a control device for a fuel injector nozzle which will permit a sharp cut off of fuel through the nozzle and into the combustion chamber thereby providing for better combustion of the fuel, less smoke and fewer emissions.

Still another object of this invention is to provide a control device for the nozzle of a fuel injector which causes a needle valve to close against the nozzle seat at a higher pressure than required to open the needle valve.

A further object of this invention is to provide a control device and a method for opening and closing a fuel injector nozzle which will eliminate secondary injections of fuel into the combustion chamber.

Still further, an object of this invention is to provide a simple and economical control device and its method of use for opening and closing a fuel injector nozzle.

Other objects and advantages of the present invention will become more apparent to those skilled in the art in view of the following description and the accompanying drawings.

DETAILED DESCRIPTION OF THE PREFERRED EMBODIMENT

Figure 1:
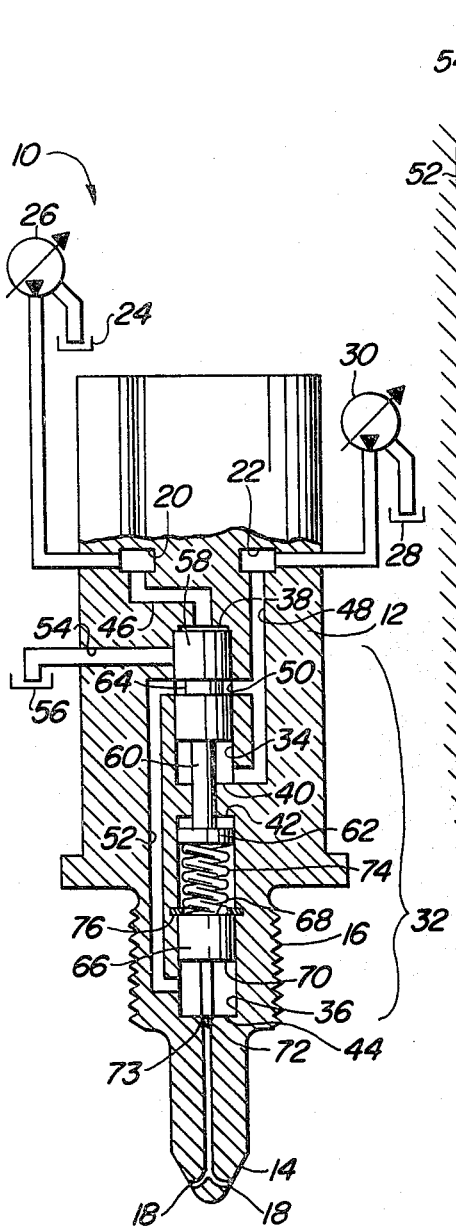
FIG. 1 is a partial sectional view of a fuel injector having the control device of this invention.

Referring to FIG. 1, a fuel injector 10 is shown having a body 12 and a nozzle 14 situated at one end thereof. The body 12 is adapted to be attached to a cylinder head of an engine by screw threads 16 such that the nozzle 14 will communicate with a combustion chamber of the engine. The nozzle 14 has at least one and preferably several orifices 18 through which a fine spray of fuel can be injected into the combustion chamber. The body 12 of the fuel injector 10 contains first and second pressure chambers, 20 and 22 respectively, with each connected to a separate supply and pressure source, indicated as 24 and 26, and 28 and 30, respectively. The first and second pressure chambers 20 and 22, which are preferably variable pressure fluid supply chambers, are equivalent to the timing and metering chambers found on some fuel injectors. The timing chamber would control the time of injection of fuel while the metering chamber would control the amount of fuel injected into the combustion chamber of an engine. Also arranged in the body 12 of the fuel injector 10 is a control device 32 which regulates the flow of fluid through the nozzle 14. The control device 32 includes first and second cavities 34 and 36 which are preferably axially aligned within the body 12 such that the second cavity 36 is located close to the nozzle 14. Each of the cavities 34 and 36 has first and second ends 38 and 40, and 42 and 44, respectively which are shown in the drawing as being the top and bottom ends of each. The cavities 34 and 36 are respectively connected between the pressure chambers 20 and 22 and to the nozzle 14 and they are connected to each other. In particular, a first passage 46 connects the first pressure chamber 20 to the top end 38 of the first cavity 34. A second passage 48 connects the second pressure chamber 22 to both the second end 40 of the first cavity 34 and to a point 50 located intermediate said first and second ends, 38 and 40 respectively. A third passage 52 connects the first cavity 34 approximate the intermediate point 50 to the second end 44 of the second cavity 36. A relief passage 54 is also present which connects the first cavity 34, approximate the first end 38, to a fluid reservoir 56. For all practical purposes, the reservoir 56 can be connected to the reservoirs 24 and 28 which are used to supply fluid to the first and second pressure chambers, 20 and 22 respectively. It should be noted that the relief passage 54 could be replaced by a relief valve connected across the first passage 46. It should also be noted that the reservoirs 24, 28 and 56 can be contained within the body 12 of the fuel injector 10 if desired but for all practical purposes they would most likely be independent of the fuel injector 10.

Figure 2:
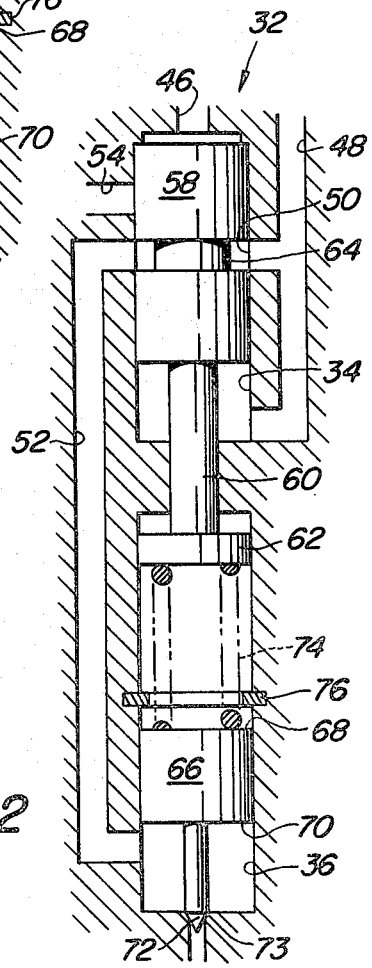
FIG. 2 is an enlarged view of the control device shown in FIG. 1 showing the spool valve in an up position and the needle valve in a closed position.
Figure 4:
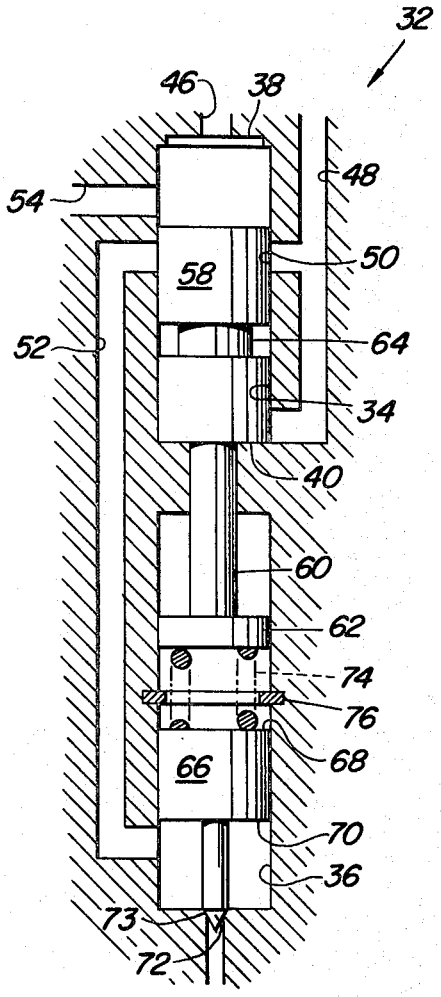
FIG. 4 is an enlarged view of the control device shown in FIG. 1 showing the spool valve in a down position and the needle valve in a closed position.

The control device 32 also includes a first valve 58, preferably a spool valve, which is movably positioned in the first cavity 34. This spool valve 58 abuts a stem 60 which protrudes into the second cavity 36 and terminates at a cross-member 62, such as a pin. The spool valve 58 includes a passage 64, preferably an annular groove, formed between two lands for permitting fluid flow through the passages 48 and 52 when the spool valve 58 is in an up or first position, as shown in FIG. 2. The spool valve 58 is movable between the first position and a downward or second position, as shown in FIG. 4, by pressure differences created in the first and second pressure chambers 20 and 22. These pressure differences are transmitted to the upper and lower ends 38 and 40 respectively, of the first cavity 34 and act on the spool valve 58. When the spool valve 58 is moved to the second or downward position, the passage 64 is no longer in communication with the intermediate point 50 and fluid flow is prevented or restricted between the passages 48 and 52. In addition, when the spool valve 58 is in its down position, it prevents exhaust gas from the engine cylinder from flowing upward through the passages 52 and 48 to the second pressure chamber 22.

A second valve 66, preferably a differential area needle valve, is positioned in the second cavity 36 and is movable between open and closed positions thereby permitting and preventing fluid flow through the nozzle 14. The needle valve 66 contains a top surface 68, an intermediate surface 70, and a conical bottom surface 72. When the needle valve 66 is in the closed position, the bottom surface 72 is resting on a seat 73 and fluid impinging on the intermediate surface 70 has a smaller area over which to operate as compared to the area of the top surface 68. When the needle valve 66 is in an up or open position, fluid can impinge on both the intermediate surface 70 and the bottom surface 72. The needle valve 66 is movable between the open and closed positions by both movement of the spool valve 58 and fluid pressure acting on its intermediate and bottom surfaces, 70 and 72 respectively. This dual actuation feature permits the control device 32 to sense a fall in pressure across the passage 64 at a time previous to a fall in pressure in the second cavity 36. Therefore, the needle valve 66 will be urged to its closed position before it actually senses a drop in pressure in the second cavity 76.

Positioned in the second cavity 36 between the top surface 68 of the needle valve 66 and the cross-member 62 is a compression spring 74. The compression spring 74 is designed to urge the spool and needle valves 58 and 66 apart. Besides the compression spring 74, a retainer ring 76 is also positioned in the second cavity 36 and acts as an upward stop for the needle valve 66.

OPERATION

Figure 3:
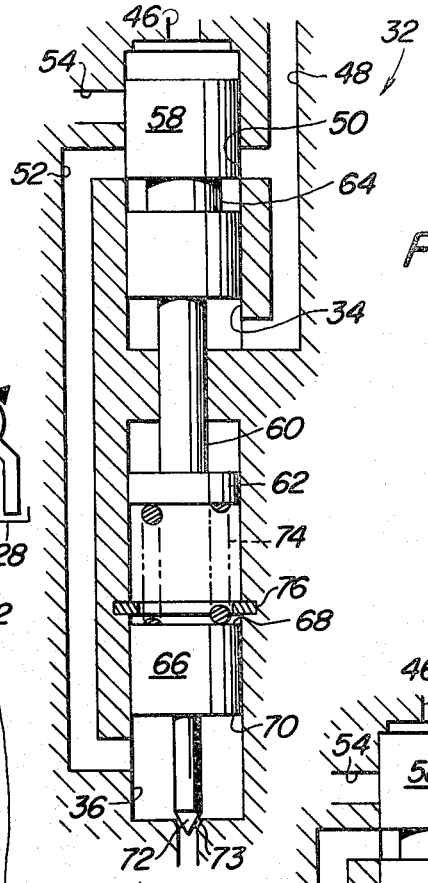
FIG. 3 is an enlarged view of the control device shown in FIG. 1 showing the spool valve in an intermediate position and the needle valve partially open.

The method of operating the control device 32 will now be explained in reference to FIGS. 2, 3 and 4. Starting from an initial position, shown in FIG. 2, wherein a zero differential pressure is present across the first and second pressure chambers, 20 and 22, the pressure is then regulated to affect movement of the control device 32. In the initial position, the spool valve 58 is in an up position and fluid flow is permitted between the passages 48 and 52 via the passage 64 and the needle valve 66 is in a closed position with its bottom surface 72 seated against the seat 73. It should also be mentioned that the spring 74 is slightly compressed so as to urge the spool and needle valves 58 and 66 apart. The fluid pressure in both the first and second pressure chambers 20 and 22 are then increased via the pumps 26 and 30, respectively, to a predetermined value, which value when multiplied by the area of the intermediate surface 70 of the needle valve 66 will yield a value equal to the compressive force in the spring 74. This pressure equalibrium permits the needle valve 66 to stay closed but ready to open upon an incremental increase in the pressure. As the fluid pressure in the two pressure chambers 20 and 22 is simultaneously increased, the fluid impinges on the intermediate surface 70 of the needle valve 66 and forces it upward against the force of the spring 74. As the needle valve 66 moves upward, fluid flow is permitted through the nozzle 14 and the orifices 18 into the combustion chamber of the engine. The upward movement of the needle valve 66 also increases the area over which the fluid can act since it will now act on both the intermediate surface 70 and the bottom surface 72. The pressure acting over this larger area is such that the force of the spring 74 is insufficient to close the needle valve 66. Therefore the needle valve 66 will remain open.

At a predetermined time, a pressure difference is created in the first and second pressure chambers 20 and 22 with the second pressure chamber 22 being at a lower pressure value such that the spool valve 58 will move downwards towards its second position. As the spool valve 58 moves downward, see FIG. 3, the passage 64 will be moved out of alignment with the intermediate point 50 such that fluid flow between the passages 48 and 52 is restricted or prevented. Simultaneously, the spring 74 is further compressed by the downward movement of the spool valve 58, the stem 60 and the cross member 62. The spring 74 will continue to be compressed until its compressive force equals the difference in pressure acting on the top of the spool valve 58 and the force acting on the surfaces 70 and 72 of the needle valve 66. At this point, the compression spring 74 will act as a mechanical link and will cause direct downward movement of the needle valve 66 relative to downward movement of the spool valve 58. Just before all fluid flow across the passage 64 is cut off by the downward movement of the spool valve 58, the compressive force in the spring 74 will equal the pressure difference between the first and second pressure chambers 20 and 22 and the needle valve 66 will start downward. As the passage 64 is moved out of alignment with the intermediate point 50, fluid flow is terminated across the spool valve 58 and the fluid pressure impinging on the intermediate and bottom surfaces 70 and 72, respectively, of the needle valve 66 will start to decrease. This decrease in pressure is due to two factors, first the amount of fluid in the second cavity is decreasing because some of the fluid is passing out through the nozzle 14, and second, the flow of fluid from the second pressure chamber 22 is restricted or blocked off. The pressure in the second cavity 36 will drop until the needle valve 66 moves completely to its closed position blocking off all flow through the nozzle 14. Since the compressive force in the spring 74 is now higher than when the needle valve 66 was moving upward, and since the fluid pressure below the needle valve 66 is decreasing, the needle valve 66 will close very fast. Therefore, it should be apparent that the force needed to close the needle valve 66 is higher than the force needed to open the needle valve 66. Such a feature is important in providing a sharp cut off of fluid through the nozzle 14 and into the combustion chamber of an engine. The higher force also prevents a reopening of the needle valve 66 before its proper time thereby assuring that no secondary injections occur.

Referring to FIG. 4, the spool valve 58 is shown in a completely down position and the needle valve 66 is shown in a closed position. In this position, all fluid entering through the passage 46 from the first pressure chamber 20 can be relieved through the relief passage 54. The opening of the relief passage 54 is to prevent physical damage to the control device 32 by preventing the spool valve 58 from slamming against the second end 40 of the first cavity 34. Even though the pressure difference between the first and second pressure chambers 20 and 22 is large, the spool valve 58 will not slam into the second end 40 because further downward movement exposes more and more of the relief passage 54 to the first end 38. It should be noted that the passage 64 is moved out of alignment with the intermediate point 50 prior to the movement of the top surface of the spool valve 58 below the port of the relief passage 54. This ensures that fluid flow across the passage 64 is restricted or cut off before any pressure is relieved through the relief passage 54. The time delay also assures that the needle valve 66 will remain closed to prevent secondary injection of fuel into the combustion chamber.

At a predetermined time, the pressure difference between the first and second pressure chambers 20 and 22 is decreased to zero and the spool valve 58 is moved upward by the force of the spring 74. In so doing, the spring 74 expands to its initial length as shown in FIG. 2 and the control device 32 is then set for another cycle.

By regulating the pressure differences between the first and second pressure chambers 20 and 22, one can regulate both the time and the amount of fuel which is metered through the fuel injector nozzle 14. The exact time of fuel injection through the nozzle 14 is determined at the point where the needle valve 66 begins to open. Likewise, the amount of fuel to be injected is determined by the compressive force of the spring and the pressure difference between the first and second pressure chambers 20 and 22 up until the spool valve 58 blocks fluid flow between the passages 48 and 52. Since the needle valve 66 will start its downward travel in response to downward movement of the spool valve 58 after the spring 74 is compressed to a predetermined value and prior to sensing a decrease in pressure on its intermediate surface 70, the control of fuel injected into a given combustion chamber can be more precisely controlled.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A control device for opening and closing a fuel injector nozzle, comprising:

(a) first and second cavities formed in said fuel injector with said second cavity located approximate said nozzle;

(b) first and second sources of pressurized fluid communicating with said respective cavities;

(c) means for regulating the flow of pressurized fluid to said cavities;

(d) a pressure activated differential area needle valve reciprocably mounted in said second cavity for movement between an open position permitting fluid flow through said nozzle and a closed position preventing fluid flow through said nozzle;

(e) a spring positioned in said second cavity and abutting a top surface of said needle valve;

(f) a controller positioned in said first cavity which can act against said spring in a direction tending to move said needle valve toward said closed position; and (g) means for reciprocably moving said controller means relative to said needle valve whereby said needle valve moves to said open position and compresses said spring upon sensing an increase in pressure in said second cavity and remains open do to an increase in surface area over which said pressurized fluid impinges, and closes at a higher pressure value in relation to movement of said controller means toward said needle valve compressing said spring further before moving said needle valve to said closed position.

2. The control device of claim 1 wherein said means for reciprocably moving said controller means is pressurized fluid supplied against opposite surfaces of said controller means at varying pressures.

3. The control device of claim 2 wherein said controller means includes a spool valve, a stem which abuts one end of said spool valve and extends into said second cavity and a cross member positioned between said stem and said spring.

4. A control device for opening and closing a fuel injector nozzle, comprising:

(a) first and second cavities defined in said fuel injector;

(b) first and second variable pressure fluid supply chambers;

(c) a differential area needle valve positioned in said second cavity and movable between an open position permitting fluid flow through said nozzle and a closed position preventing fluid flow through said nozzle;

(d) means for urging said needle valve toward said closed position with a greater force than required to move said needle valve to said open position, said means including a spool valve positioned in said first cavity, a stem abutting said spool valve and extending into said second cavity, a cross-member positioned in said second cavity and abutting said stem, and a spring positioned in said second cavity between said cross-member and said needle valve;

(e) passage means for connecting said first fluid supply chamber to said first cavity approximate one surface of said spool valve, for connecting said second fluid supply chamber to said first cavity approximate an opposite surface of said spool valve, and for connecting said second fluid supply chamber to said second cavity approximate said nozzle; and (f) means for reciprocably moving said spool valve relative to said needle valve whereby said needle valve moves to said open position and compresses said spring upon sensing an increase in pressure in said second cavity and remains open due to an increase in surface area over which said pressurized fluid impinges, and closes at a higher pressure value in relation to movement of said spool valve towards said needle valve which compresses said spring further before moving said needle valve to said closed position.

5. A control device for opening and closing a nozzle in a fuel injector, said control device comprising:

(a) first and second variable pressure fluid supply chambers;

(b) first and second cavities defined in said fuel injector with said second cavity located close to said nozzle, each of said cavities having first and second ends;

(c) passages formed within said fuel injector connecting said first pressure chamber to said first end of said first cavity, said second pressure chamber to both said second end of said first cavity and to a point intermediate said first and second ends of said first cavity, and said first cavity approximate said intermediate point to said second end of said second cavity;

(d) a first valve movably positioned in said first cavity having a passage therethrough which is aligned with said passages arranged approximate said intermediate point of said first cavity when said first valve is in a first position and which is out of alignment with said passages arranged approximate said intermediate point of said first cavity when said first valve is in a second position, said first valve being movable between said first and second positions by pressure differences created in said first and second pressure chambers;

(e) a second valve positioned in said second cavity which is movable relative to both movement of said first valve and to fluid pressure acting thereon to move between an open position permitting fluid flow through said nozzle and a closed position preventing fluid flow through said nozzle;

(f) a stem abutting said spool valve and extending into said second cavity, said stem terminating at a cross-member; and (g) biasing means situated in said second cavity between said cross-member and said second valve for urging said first and second valves apart.

6. The control device of claim 5 wherein a relief passage is formed in said fuel injector which communicates between a point adjacent said first end of said first cavity and a sump for relieving pressure from said first end of said first cavity.

7. The control device of claim 6 wherein said relief passage communicates with a point of said first cavity such that movement of said first valve towards said second position blocks fluid flow through said passages arranged approximate said intermediate point of said first cavity before said relief passage is open to said sump.

8. The control device of claim 6 wherein said relief passage communicates with a point of said first cavity such that movement of said first valve towards said second position restricts fluid flow through said passages arranged approximate said intermediate point of said first cavity before said relief passage is open to said sump.

9. The control device of claim 5 wherein said first valve is a spool valve and said passage means is a groove formed in said spool valve.

10. The control device of claim 5 wherein said second valve is a needle valve.

11. The control device of claim 10 wherein said needle valve is a differential area needle valve.

12. The control device of claim 11 wherein said spring is compressed between said cross-member and said needle valve.

13. The control device of claim 12 wherein said needle valve is a differential area needle valve having a smaller surface area exposed to impinging fluid pressure when in said closed position then when in said open position.

14. A control device for opening and closing a nozzle in a fuel injector, said control device comprising:

(a) first and second variable pressure fluid supply chambers;

(b) first and second cavities formed in said fuel injector with said second cavity located adjacent to said nozzle, each of said cavities having first and second ends;

(c) fluid passages formed in said fuel injector connecting said first pressure chamber to said first end of said first cavity, said second pressure chamber to both said second end of said first cavity and to a point intermediate said first and second ends of said first cavity, said first cavity approximate said intermediate point to said second end of said second cavity, and said first cavity approximate said first end to a sump;

(d) a spool valve movably positioned in said first cavity and abutting a stem which protrudes into said second cavity, said spool valve having a passage therethrough for permitting fluid flow through said passages arranged approximate said intermediate point of said first cavity when said spool valve is in a first position and preventing fluid flow through said passages arranged approximate said intermediate point of said first cavity when said spool valve is in a second position, said spool valve being movable between said first and second positions by a pressure difference created in said first and second pressure chambers;

(e) a needle valve positioned in said second cylinder which is movable relative to both pressure differences in said first and second pressure chambers and to movement of said spool valve to move between an open position permitting fluid flow through said nozzle and a closed position preventing fluid flow through said nozzle; and (f) a spring situated in said second cavity between said stem and said second valve for urging said needle valve to said closed position and assisting in transmitting a force to said needle valve as said spool valve moves towards its second position such that said needle valve starts to close before a decrease in pressure is sensed in said second cavity.

15. The control device of claim 14 wherein said spool valve blocks fluid flow through said passages arranged approximate said intermediate point of said first cavity before said passage leading to said sump is opened.

16. The control device of claim 14 wherein a retaining ring is positioned within said second cavity to limit travel of said needle valve.

17. A control device for opening and closing a nozzle in a fuel injector, said control device comprising:

(a) first and second variable pressure fluid supply chambers;

(b) first and second axially aligned cylindrical cavities formed in said fuel injector with said second cavity located adjacent to said nozzle, each of said cavities having first and second ends;

(c) a first fluid passage formed within said fuel injector which connects said first pressure chamber to said first end of said first cavity;

(d) a second fluid passage formed within said fuel injector which connects said second pressure chamber to both said second end of said first cavity and to a point intermediate said first and second ends of said first cavity;

(e) a third fluid passage formed within said fuel injector which connects said first cavity approximate said intermediate point to said second end of said second cavity;

(f) a relief passage formed within said fuel injector which connects said first cavity approximate said first end to a sump;

(g) a spool valve movably positioned in said first cavity and abutting a stem which protrudes into said second cavity and terminates into a cross-member, said spool valve having a groove formed therein for permitting fluid flow through said passages arranged approximate said intermediate point of said first cavity when said spool valve is in a first position and preventing fluid flow through said passages arranged approximate said intermediate point of said first cavity when said spool valve is in a second position, said spool valve being movable between said first and second positions by a pressure difference created in said first and second pressure chambers;

(h) a needle valve positioned in said second cavity which is movable relative to both pressure fluctuations in said third fluid passage and to movement of said spool valve, said needle valve movable between an open position permitting fluid flow through said nozzle and a closed position preventing fluid flow through said nozzle; and (i) a spring situated in said second cavity between said cross-member and said needle valve for urging said needle valve to said closed position and assisting in transmitting a force to said needle valve as said spool valve moves towards its second position such that said needle valve starts to close before a decrease in pressure is sensed in said second cavity.

18. A method for controlling the opening and closing of a fuel injector nozzle, said fuel injector having first and second cavities formed therein, first and second sources of pressurized fluid communicating with said respective cavities, means for regulating the flow of pressurized fluid to said cavities, a differential area needle valve reciprocably mounted in said second cavity for movement between an open position permitting fluid flow through an outlet passage in said nozzle and a closed position preventing fluid flow through said outlet passage, said needle valve having intermediate and bottom surfaces facing toward said outlet passage, a spring positioned in said second cavity for urging said needle valve to said closed position, and controller means contacting said spring and capable of transmitting a force against said needle valve in a direction tending to move said needle valve toward said closed position, said method comprising the steps of:

(a) subjecting said intermediate surface of said needle valve to said second source of pressurized fuel sufficient to compress said spring and move said needle valve to said open position whereby said bottom surface of said needle valve is exposed to said pressurized fuel and contributes in retaining said needle valve in said open position;

(b) subjecting said controller means to said first source of pressurized fuel sufficient to move said controller means toward said needle valve thereby further compressing said spring, said spring being compressible to a predetermined value such that when said predetermined value is reached, a mechanical link is formed between said needle valve and said controller means:

(c) applying sufficient pressure to said controller means from said first source of pressurized fluid to force said needle valve toward said closed position whereby the area of said bottom surface of said needle valve exposed to impinging pressure is decreased and the amount of force exerted on said intermediate surface of said needle valve is insufficient to prevent said spring from expanding, such expansion cooperating with said downward movement of said controller means to cause said needle valve to move to said closed position under greater pressure than needed to move said needle valve to said open position.

19. The method of claim 18 wherein said pressure difference across said controller means is regulated to permit said controller means to move away from said needle valve thereby permitting said spring to expand to its original length.

20. A method for controlling the opening and closing of a nozzle in a fuel injector, said fuel injector having first and second variable pressure fluid supply chambers, first and second axially aligned cavities formed therein, each having first and second ends, said second cavity located adjacent to said nozzle, a first fluid passage connecting said first pressure chamber to said first end of said first cavity, a second fluid passage connecting said second pressure chamber with both said second end of said first cavity and with a point located intermediate said first and second ends of said first cavity, a third fluid passage connecting said first cavity approximate said intermediate point to said second end of said second cavity, a relief passage connecting said first cavity approximate said first end to a sump, a spool valve movably positioned in said first cavity and abutting a stem which protrudes into said second cavity and terminates at a cross-member, said spool having a passage formed therein for permitting fluid flow through said passages arranged approximte said intermediate point when said spool valve is in a first position and preventing fluid flow through said passages arranged approximate said intermediate point when said spool valve is in a second position, a needle valve positioned in said second cavity which is movable relative to both movement of said spool valve and to fluid pressure impinging thereon to move between an open position permitting fluid flow through said nozzle and a closed position preventing fluid flow through said nozzle and a spring situated in said second cylinder between said cross-member and said needle valve for urging said needle valve to said closed position and assisting in transmitting a force to said needle valve as said spool valve moves towards its second position, said method comprising the steps of:

(a) regulating the fluid pressure in both said first and second pressure chambers to obtain an equal pressure value in each chamber which is less than the compressive force of said spring such that said spool valve is retained in said first position and said needle valve is retained in said closed position;

(b) increasing the pressure in said first and second pressure chambers to a predetermined value which when multiplied by the area of an exposed surface on said needle valve will yield a value equal to the force in said spring thereby placing said needle valve in a ready to open state;

(c) adjusting the pressure still further in said first and second pressure chambers to a value which results in a force acting on said needle valve which is higher than the force in said spring thereby compressing said spring and opening said needle valve so that the differential area of said exposed surface is increased and the force of said spring alone is insufficient to close said needle valve;

(d) creating a pressure difference between said first and second pressure chambers such that said second pressure chamber is at a lower pressure and said spool valve is moved towards said second position compressing said spring further and partially blocking the flow of fluid between said second and third passages;

(e) further adjusting the pressure difference between said first and second pressure chambers such that said second pressure chamber is at a lower pressure and said spool valve is moved towards said second position restricting fluid flow between said second and third passages, and said needle valve is urged towards said closed position by movement of said spool valve and expansion of said spring at a greater force than was required to open said needle valve.

21. The method of claim 20 wherein further movement of said spool valve to said second position opens up said relief passage thereby permitting fluid flow between said first passage and said relief passage.

22. The method of claim 21 wherein the pressure difference between said first and second pressure chambers is reduced to zero and said spool valve is moved to said first position thereby permitting fluid flow between said second and third passages.

* * * * *